US007888886B2

(12) United States Patent
Wu

(10) Patent No.: US 7,888,886 B2
(45) Date of Patent: Feb. 15, 2011

(54) UNIVERSAL LINE VOLTAGE DIMMING METHOD AND SYSTEM

(75) Inventor: Mingliang Wu, Schaumburg, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 309 days.

(21) Appl. No.: 11/914,139

(22) PCT Filed: May 9, 2006

(86) PCT No.: PCT/IB2006/051459

§ 371 (c)(1),
(2), (4) Date: Jun. 2, 2008

(87) PCT Pub. No.: WO2006/120641

PCT Pub. Date: Nov. 16, 2006

(65) Prior Publication Data

US 2008/0252233 A1 Oct. 16, 2008

Related U.S. Application Data

(60) Provisional application No. 60/679,352, filed on May 10, 2005.

(51) Int. Cl.
*H05B 37/02* (2006.01)

(52) U.S. Cl. ..... 315/307; 315/224; 315/DIG. 4

(58) Field of Classification Search ..... 315/291, 315/307, 224, DIG. 4
See application file for complete search history.

(56) References Cited

U.S. PATENT DOCUMENTS

| | | | | |
|---|---|---|---|---|
| 6,486,616 | B1 * | 11/2002 | Liu et al. | 315/291 |
| 2004/0135523 | A1 | 7/2004 | Takahashi et al. | |
| 2005/0017656 | A1 | 1/2005 | Takahashi et al. | |
| 2005/0029962 | A1 | 2/2005 | Onn Fag | |
| 2005/0122057 | A1 * | 6/2005 | Chen et al. | 315/224 |

FOREIGN PATENT DOCUMENTS

| | | |
|---|---|---|
| EP | 1128711 | 8/2001 |
| WO | 2004110110 A1 | 12/2004 |

* cited by examiner

*Primary Examiner*—David Hung Vu

(57) ABSTRACT

A universal line voltage dimming method and system, with a control circuit for an electronic ballast including an on-time converter (50) generating an on-time signal (54) in response to a sensed phase-controlled power signal (52), and a microprocessor (56) responsive to the on-time signal (54) and generating a dimming control signal (58). A lamp control method for an electronic ballast includes sensing phase-controlled power, determining on-time for the sensed phase-controlled power, and controlling lamp dimming in response to the on-time.

22 Claims, 4 Drawing Sheets

UNIVERSAL LINE VOLTAGE DIMMING METHOD AND SYSTEM

CROSS REFERENCE TO RELATED APPLICATION

This application claims the benefit of U.S. provisional application Ser. No. 60/679,352, filed May 10, 2005, the entire subject matter of which is hereby incorporated by reference.

This invention relates generally to lamp dimming control, and more specifically to a method and system for lamp dimming with universal line voltages.

Electronic ballasts for fluorescent lamps have become sophisticated and are widely used in a variety of applications. One application that has presented problems is dimmable electronic ballasts. Modern dimming switches, such as triac dimmers, generate a phase-controlled power with reduced on-time, i.e., the time in which the chopped phase-controlled power is non-zero. The line input power briefly crosses zero power between positive and negative, but the phase-controlled power holds the zero power longer to limit power to a load. Triac dimmers work well for resistive loads, such as incandescent lamps, but work poorly or not at all for non-linear loads, such as ballasts for fluorescent lamps. Non-linear loads can hum, buzz, run hot, or burn out.

Dimmable electronic ballasts have been designed to work with triac dimmers, but such dimmable electronic ballasts are limited to use with a predetermined line input voltage, e.g., a dimmable electronic ballast for triac dimmers designed to operate at 120 Volts cannot be used with a 277 Volt line input voltage. The dimming control voltage signal is generated within the dimmable electronic ballast, so the voltage of the dimming control voltage signal is affected by the line input voltage to the dimmable electronic ballast. Attempting to use present dimmable electronic ballast for triac dimmers at a voltage other than the predetermined line input voltage gives rise to problems with power factor, total harmonic distortion, and stability. The requirement that different dimmable electronic ballasts be used for different predetermined line input voltages causes additional expense in manufacturing and stocking different dimmable electronic ballasts for different line input voltages.

It would be desirable to provide a universal line voltage dimming method and system that overcomes the above disadvantages.

One aspect of the invention provides a control circuit for an electronic ballast including an on-time converter generating an on-time signal in response to a sensed phase-controlled power signal, and a microprocessor responsive to the on-time signal and generating a dimming control signal.

Another aspect of the invention provides a lamp control method for an electronic ballast including sensing phase-controlled power, determining on-time for the sensed phase-controlled power, and controlling lamp dimming in response to the on-time.

Another aspect of the invention provides a lamp control system including means for sensing phase-controlled power, means for determining on-time for the sensed phase-controlled power, and means for controlling lamp dimming in response to the on-time.

Another aspect of the invention provides control circuit for an electronic ballast having a boost/power factor controller including a line voltage detector generating a line voltage signal in response to a sensed phase-controlled power signal, a microprocessor responsive to the line voltage signal and generating a capacitance selector signal, and a capacitance circuit responsive to the capacitance selector signal to adjust capacitance of the boost/power factor controller.

Another aspect of the invention provides a lamp control method for an electronic ballast including sensing a phase-controlled power, determining line voltage for the sensed phase-controlled power, and adjusting boost/power factor controller capacitance in response to the line voltage.

Another aspect of the invention provides a lamp control system including means for sensing a phase-controlled power, means for determining line voltage for the sensed phase-controlled power, and means for adjusting boost/power factor controller capacitance in response to the line voltage.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

Figure 1:
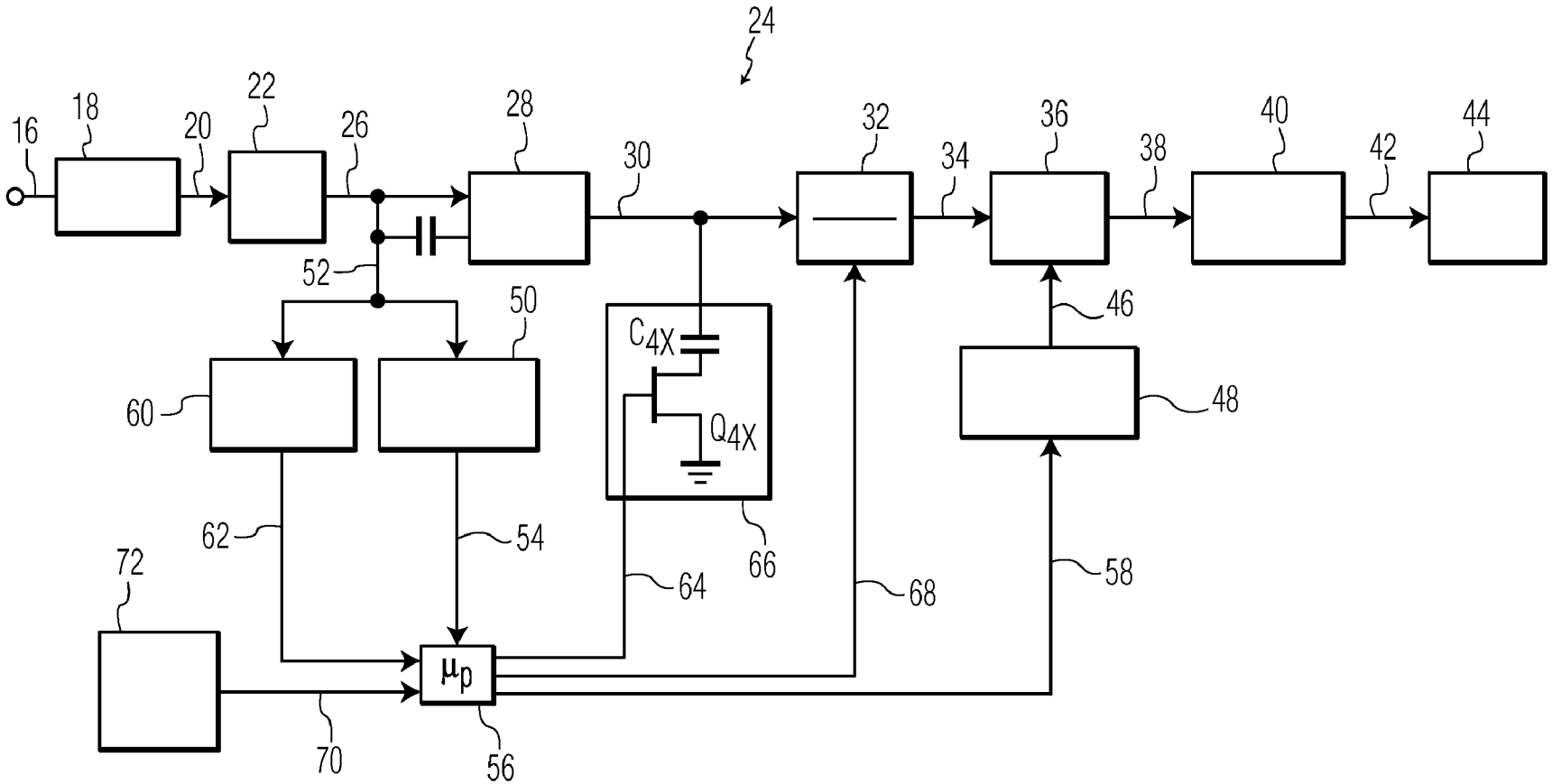
FIG. 1 is a block diagram of a lighting system with a universal dimming electronic ballast made in accordance with the present invention.

FIG. 1 is a block diagram of a lighting system with a universal dimming electronic ballast made in accordance with the present invention. The electronic ballast adapts to any phase-controlled power provided by a dimmer to produce the lamp dimming desired. The wave form of the power to the lamp is unaffected by the line voltage. An on-time converter converts the phase-controlled power to an on-time, which is converted to a dimming control signal. A line voltage detector detects line voltage and adjusts boost circuit capacitance through a capacitance selection circuit and/or adjusts the power factor controller internal multiplier through a stability circuit to maintain electronic ballast operating stability. Those skilled in the art will appreciate that the phase-controlled power can be supplied by any phase-control device, such as a triac dimmer or the like.

Electronic ballast 24 receives phase-controlled power 20 from dimmer 18 at EMI filter 22 and provides lamp power 42 for a lamp 44 from resonant tank 40. The dimmer 18 receives mains power 16, such as 120 Volt or 277 Volt power line power, and controls the phase of the mains power 16 to reduce the power provided to the electronic ballast 24 and dim the lamp 44. The exemplary electronic ballast 24 includes the EMI filter 22 operably connected to the dimmer 18 and a DC rectifier 28, which provides rectified power 30 to boost/power factor controller (PFC) 32. The boost/PFC 32 provides DC bus power 34 to switching circuit 36, which provides switched power 38 to resonant tank 40. The switching circuit 36 is responsive to switching control signal 46 from a switching controller 48. The resonant tank 40 provides lamp power 42 to the lamp 44.

The electronic ballast 24 can include a dimming circuit with an on-time converter 50 receiving a sensed phase-controlled power signal 52 and generating an on-time signal 54. A microprocessor 56 in the dimming circuit is responsive to the on-time signal 54 to generate a dimming control signal 58, which is provided to the switching controller 48. The dimming circuit senses the phase-controlled power, calculates on-time for the sensed phase-controlled power, and controls lamp dimming in response to the on-time. As defined herein, on-time is the duration for which each positive or negative voltage pulse of the sensed phase-controlled power signal 52 is non-zero. Those skilled in the art will appreciate that in alternate embodiments the microprocessor 56 can be conventional circuits, rather than an integrated circuit programmable microprocessor; the functions of the microprocessor 56 can be performed by conventional circuits rather than the programmable microprocessor as desired. The microprocessor 56 receives DC power 70 from a DC power supply 72. The DC power supply 72 can be powered from any suitable location within the electronic ballast 24, such as the DC bus.

The electronic ballast 24 can include a capacitance selection circuit with a line voltage detector 60 receiving the sensed phase-controlled power signal 52 and generating a line voltage signal 62. The microprocessor 56 is responsive to the line voltage signal 62 to generate a capacitance selector signal 64, which is provided to capacitance circuit 66. The capacitance circuit 66 is operably connected to adjust the capacitance to the boost/PFC 32. The capacitance selection circuit implements a lamp control method that senses a phase-controlled power, determines line voltage for the sensed phase-controlled power, and adjusts boost/PFC capacitance in response to the line voltage.

The electronic ballast 24 can include a stability circuit with the line voltage detector 60 receiving the sensed phase-controlled power signal 52 and generating the line voltage signal 62. The microprocessor 56 is responsive to the line voltage signal 62 to generate an internal multiplier signal 68, which is provided to the boost/PFC 32. The stability circuit implements a lamp control method that senses a phase-controlled power, determines line voltage for the sensed phase-controlled power, and selects a boost/PFC internal multiplier in response to the line voltage.

Figure 2:
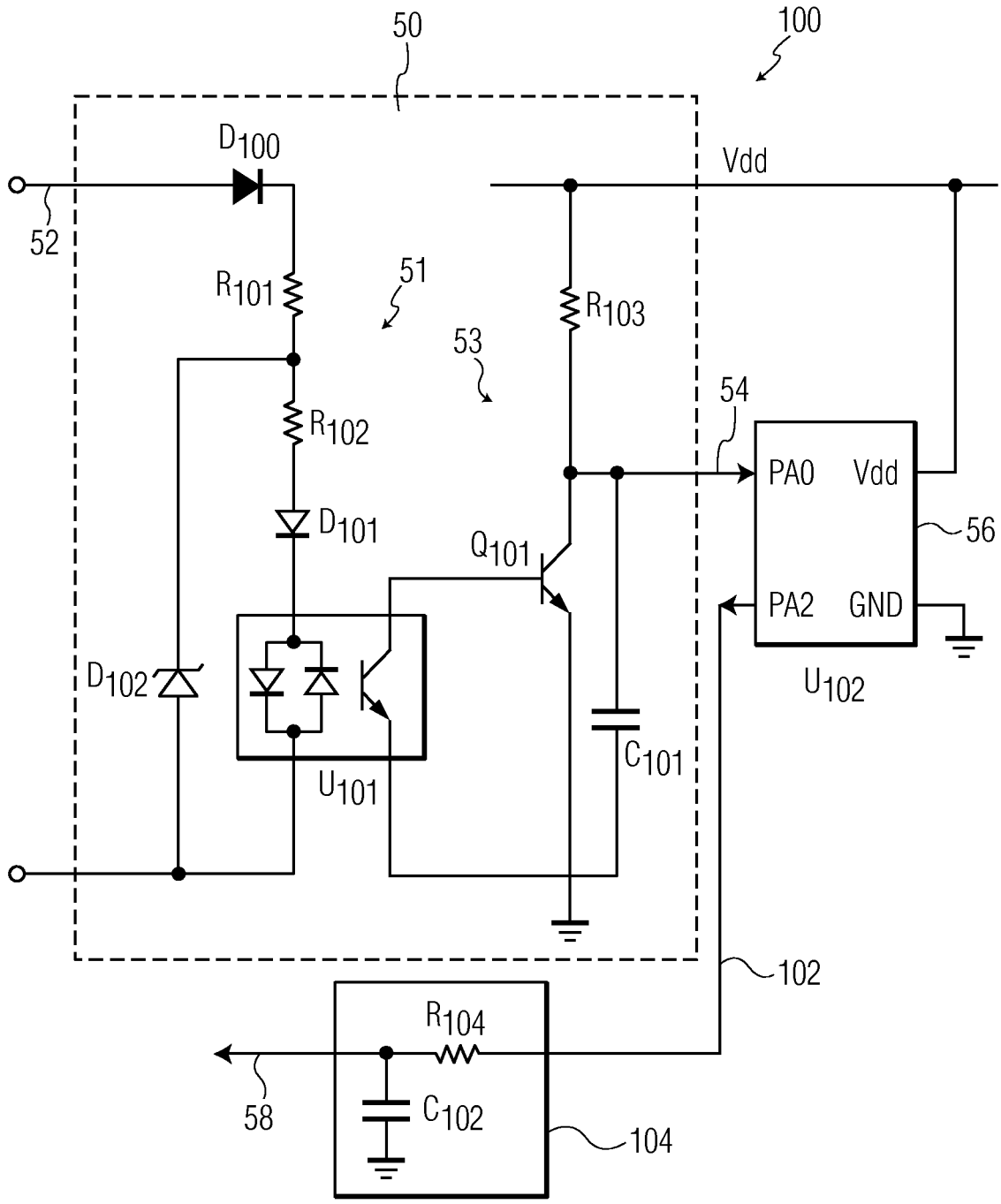
FIGS. 2 & 3A-3C are a schematic diagram and voltage traces, respectively, for a dimming circuit for a universal dimming electronic ballast made in accordance with the present invention.

FIG. 2, in which like elements share like reference numbers with FIG. 1, is a schematic diagram of a dimming circuit for a universal line voltage dimming circuit made in accordance with the present invention. FIG. 3 illustrates voltage traces for the dimming circuit of FIG. 2. Referring to FIG. 2, dimming circuit 100 includes on-time converter 50 and microprocessor 56. The on-time converter 50 receives sensed phase-controlled power signal 52 and generates on-time signal 54. The microprocessor 56 receives the on-time signal 54 and generates pulsed dimming control signal 102, which is converted to the smoothed dimming control signal 58 by filter 104.

The on-time converter 50 includes rectifier D100 operably connected to a clipping circuit 51 and a switching circuit 53 operably connected to the clipping circuit 51 through an isolator U101. The clipping circuit 51 includes voltage divider resistors R101 and R102, Zener diode D102 connected between common and the junction of resistors R101 and R102, and optional diode D101. The diode D101 can be omitted when the current through the isolator U101 only flows in one direction, i.e., the isolator U101 receives a DC input. The on-time converter 50 also includes the isolation path diode side of isolator U101 operably connected in series with the diode D101 and the isolation path phototransistor side of isolator U101 operably connected between common and the base of switching transistor Q101. The isolator U101 in this example is an AC sensing phototransistor output optocoupler, although a DC sensing phototransistor output optocoupler can be used in this embodiment because the current through the isolator U101 only flows in one direction. The isolator U101 can be any suitable isolator, such as an optocoupler, an isolation transformer, or the like. The switching circuit 53 includes resistor R103 and capacitor C101 connected in series between Vdd and common, switching transistor Q101 with the collector-emitter path connected in parallel to the capacitor C101, and isolator U101 with the isolation path phototransistor side connected between the base of the switching transistor Q101 and common. The collector of the switching transistor Q101 is connected to terminal PA0 of the microprocessor 56 to provide the on-time signal 54 to the microprocessor 56.

Figure 3A:
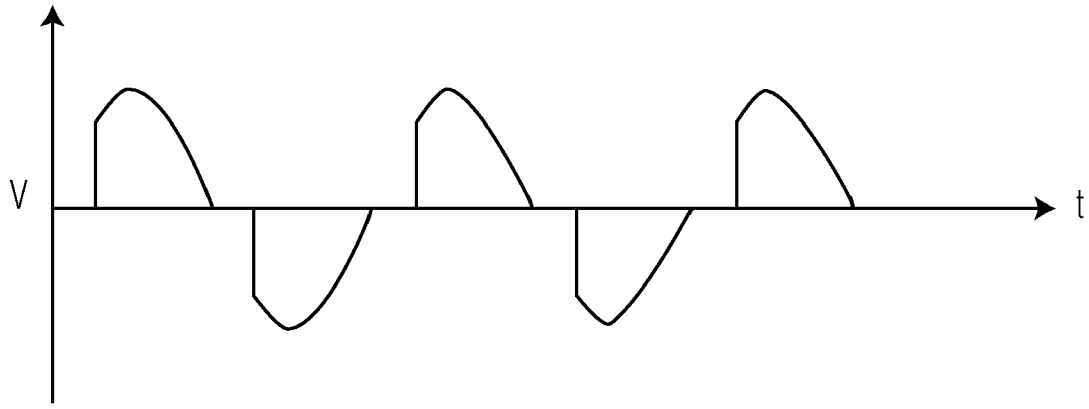
Figure 3B:
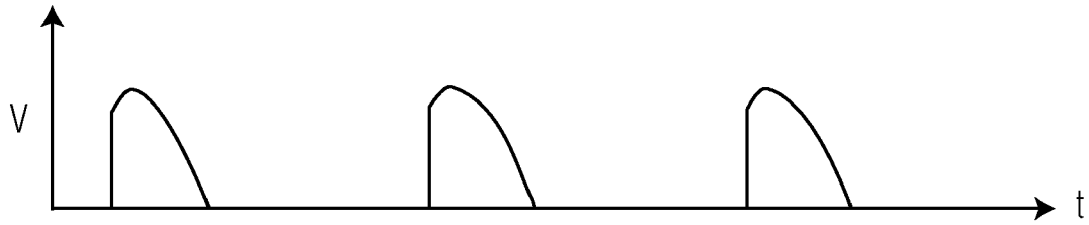
Figure 3C:
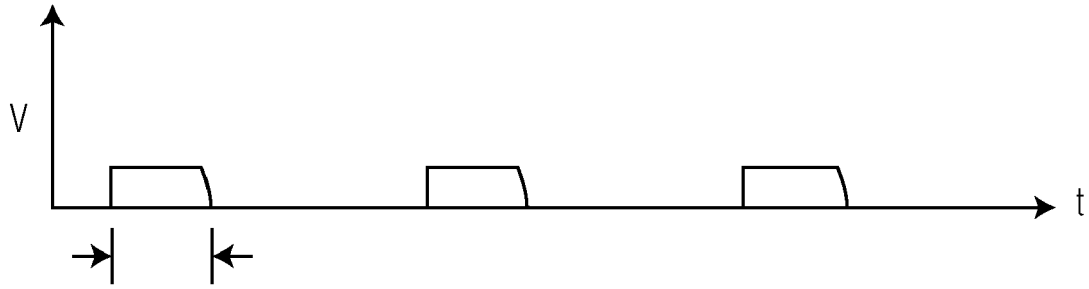

In operation, the on-time converter 50 receives the phase-controlled power signal 52, which is shown in Trace A of FIG. 3A. The phase-controlled power signal 52 is phase-controlled, i.e., the voltage is held at zero for a portion of the cycle to reduce power to the lamp and dim the lamp. The rectifier D100 rectifies the phase-controlled power signal 52, resulting in the rectified phase-controlled power shown in Trace B of FIG. 3B, corresponding to the rectified phase-controlled power at the location between the rectifier D100 and the resistor R101. In an alternative embodiment, the rectifier can be a full wave rectifier rather than the half wave rectifier D100. The clipping circuit conducts through diode D101 until the voltage at the junction of resistors R101 and R102 exceeds the reverse breakdown voltage of the Zener diode D102, so that the Zener diode D102 then conducts as well and limits the voltage at the junction of resistors R101 and R102. Trace C of FIG. 3C illustrates the voltage of the on-time pulses at the junction of resistors R101 and R102. The on-time is the time between the leading and the lagging edge of each on-time pulse. The on-time pulses switch the current through the diode of the isolator U101, which switches the state of the phototransistor of the isolator U101 and the switching transistor Q101, in turn. The switching transistor Q101 switches voltage from resistor R103 across capacitor C101 to generate the on-time signal 54 at the junction between the resistor R103 and capacitor C101.

The microprocessor 56 analyzes the on-time signal 54 for the on-time and generates the pulsed dimming control signal 102 in accordance with instructions and data stored in the microprocessor 56. The microprocessor 56 detects when the on-time signal 54 goes above a predetermined level, such as 2.5 Volts, to start timing the on-time and when the on-time signal 54 goes below the predetermined level to finish timing the on-time. In an alternate embodiment, the on-time is determined from the slope change of the on-time signal 54 at the leading edge and the lagging edge of the on-time pulse. Those skilled in the art will appreciate that the on-time signal 54 can be inverted as desired, so that the timing the on-time starts and ends when the on-time signal 54 passes beyond the predetermined level, not necessarily exceeding or falling below the predetermined level.

The on-time is converted to the pulsed dimming control signal 102 by calculation or look up table in the microprocessor 56. In one embodiment, the on-time is determined for a single on-time pulse from the on-time signal 54. In an alternate embodiment, the on-time is a moving average on-time determined for a predetermined number of on-time pulses from the on-time signal 54, such as 2, 3, 4, 8, or 16 on-time pulses. In another alternate embodiment, the on-time is a time-weighted average, such as an average assigning greater statistical weight to the more recent on-time pulses. In one embodiment, the conversion from the on-time to the pulsed dimming control signal 102 is a linear function. In an alternate embodiment, the conversion from the on-time to the pulsed dimming control signal 102 is a non-linear function. For example, the conversion can be a logarithmic function to account for the fact that human eyes perceive a higher light level for a dimmed light than the actual light level that would be recorded by a light meter. In one embodiment, the span and offset of the conversion can be selected, e.g., an on-time of about 8.3 milliseconds converts to a full on pulsed dimming control signal 102, an on-time of about 4 milliseconds converts to a middle pulsed dimming control signal 102, and an on-time of about 2.8 milliseconds converts to a minimum pulsed dimming control signal 102.

The microprocessor 56 generates the pulsed dimming control signal 102, which is converted to the smoothed dimming control signal 58 by the filter 104. The filter 104 includes resistor R104 and capacitor C102. The span and offset of the smoothed dimming control signal 58 can be selected for the desired application, such as about 0.3 to 2.8 Volts corresponding to minimum light output (maximum dimming) and full on light output, respectively. In an alternate embodiment, the microprocessor 56 generates an analog signal as the dimming control signal 58 and the filter 104 can be omitted. A control microprocessor in the switching controller receives the smoothed dimming control signal 58 and provides the switching control signal to the switching circuit to set the desired lamp dimming level. In an alternate embodiment, the microprocessor 56 generates a pulsed signal as the dimming control signal 58 and the control microprocessor in the switching controller is responsive to the pulsed signal.

Figure 4:
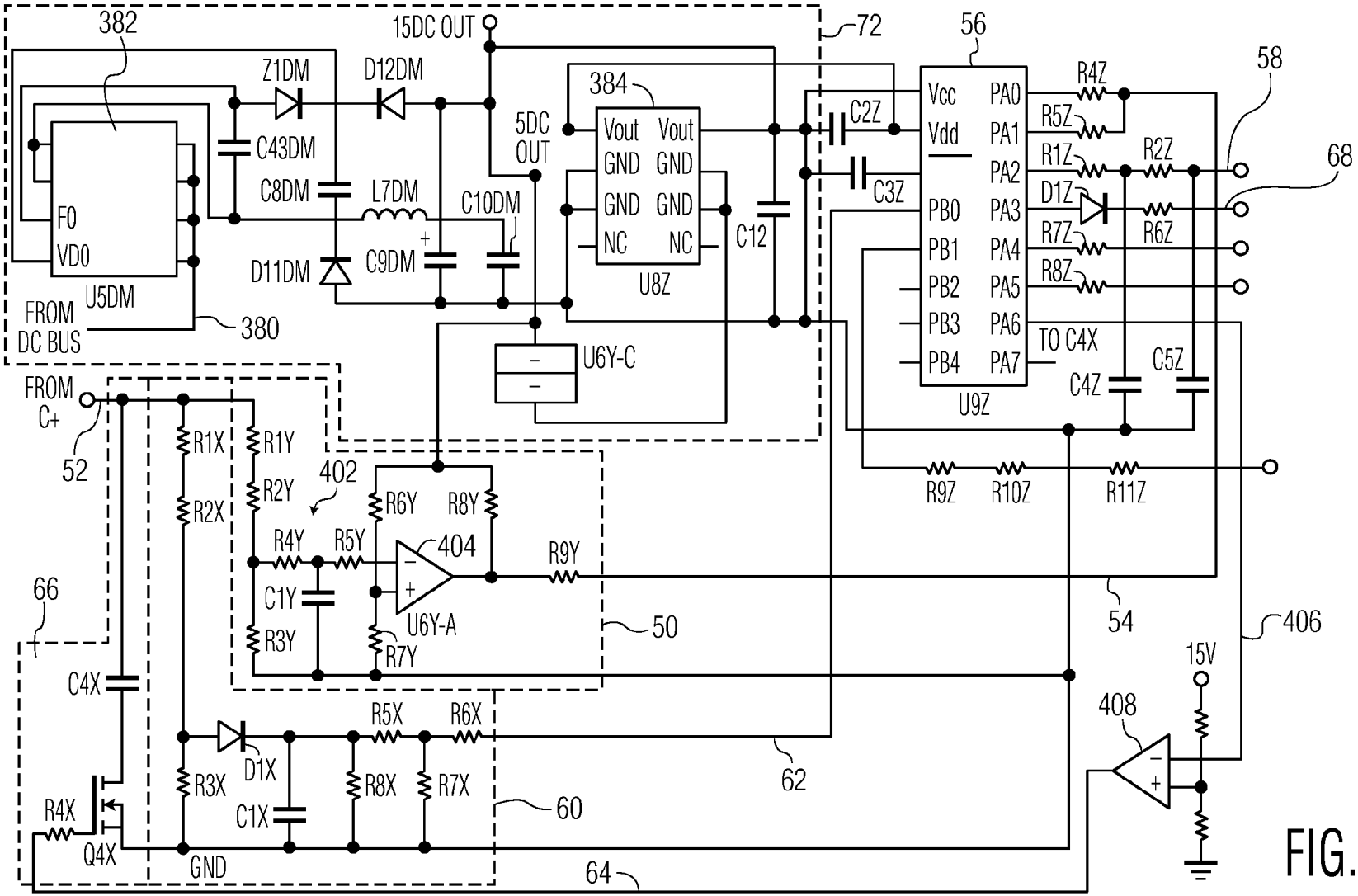
FIG. 4 is a schematic diagram of dimming, capacitance selection, and stability circuits for a universal dimming electronic ballast made in accordance with the present invention.

FIG. 4, in which like elements share like reference numbers with FIG. 1, is a schematic diagram of dimming, capacitance selection, and stability circuits for a universal dimming electronic ballast made in accordance with the present invention. The dimming circuit converts the sensed phase-controlled power signal to a dimming control signal, the capacitance selection circuit detects the line voltage and switches capacitance at the boost/PFC, and the stability circuit detects the line voltage and provides that information to the boost/PFC. DC power supply 72 receives DC bus power 380 and powers the microprocessor circuit, capacitance selection circuit, stability circuit, and other components as desired. The DC power supply 72 includes 15V power supply 382 and 5V power supply 384.

The dimming circuit includes the on-time converter 50 and the microprocessor 56. The on-time converter 50 receives the sensed phase-controlled power signal 52 and generates the on-time signal 54. The microprocessor 56 receives the on-time signal 54 and generates dimming control signal 58. The on-time converter 50 includes scaling circuit 402 and comparator 404. The scaling circuit 402 scales and smoothes the sensed phase-controlled power signal 52, which is compared to a predetermined voltage at the comparator 404 to generate the dimming control signal 58. The processing of the dimming control signal 58 to generate the switching control signal 46 is discussed above in conjunction with FIGS. 2 & 3.

The capacitance selection circuit includes the line voltage detector 60, microprocessor 56, and capacitance circuit 66. The line voltage detector 60 detects the voltage of the main power feeding the dimmer. In this example, the line voltage detector 60 is a line peak detector which provides a line voltage signal 62 proportional to the peak voltage of the sensed phase-controlled power signal 52. The microprocessor 56 detects the level of the line voltage signal 62 and determines whether the main power is high voltage, such as 277 Volts, or a lower voltage, such as 120 Volts. In this example, the microprocessor 56 generates an inverted capacitance selector signal 406, which is inverted at inverter 408 to generate the capacitance selector signal 64. When the main power is high voltage, the microprocessor 56 sets the inverted capacitance selector signal 406 to a first level and when the main power is not high voltage, the microprocessor 56 sets the inverted capacitance selector signal 406 to a second level. When the main power is high voltage as indicated by the capacitance selector signal 64, transistor Q4X in the capacitance circuit 66 is off and no extra capacitance is added to the boost/PFC. When the main power is not high voltage as indicated by the capacitance selector signal 64, transistor Q4X in the capacitance circuit 66 is on and extra capacitor C4X is added to the boost/PFC. Decreasing capacitance increases stability at the higher main power voltage. Using different capacitance values also improves power factor and total harmonic distortion at the different main power voltages.

The stability circuit includes the line voltage detector 60 and microprocessor 56. As discussed above for the capacitance selection circuit, the line voltage detector 60 receives the sensed phase-controlled power signal 52 and generates the line voltage signal 62 at the microprocessor 56. The microprocessor 56 detects the level of the line voltage signal 62 and determines whether the main power is high voltage, such as 277 Volts, or a lower voltage, such as 120 Volts. When the main power is high voltage, the microprocessor 56 sets the internal multiplier signal 68 to a first level and when the main power is not high voltage, the microprocessor 56 sets the internal multiplier signal 68 to a second level. The internal multiplier signal 68 is provided to the boost/PFC, such as the MULTIN pin of a PFC integrated circuit in the boost/PFC. When the main power is high voltage as indicated by the internal multiplier signal 68, the MULTIN pin of a PFC integrated circuit is held at a first level. When the main power is not high voltage as indicated by the internal multiplier signal 68, the MULTIN pin of a PFC integrated circuit is held at a second level. For example, in one embodiment the first level is low and the second level is high. Those skilled in the art will appreciate that the effect of feeding a small current to the MULTIN pin voltage to increase stability of the PFC integrated circuit depends on the particular electronic ballast design, so that whether the MULTIN pin is held high or low for high voltage depends on the particular electronic ballast design.

While the embodiments of the invention disclosed herein are presently considered to be preferred, various changes and modifications can be made without departing from the scope of the invention. Those skilled in the art will appreciate that the embodiments described for FIGS. 1, 2, & 4 are exemplary and that alternative circuits can be used as desired for particular applications. The scope of the invention is indicated in the appended claims, and all changes that come within the meaning and range of equivalents are intended to be embraced therein.

The invention claimed is:

1. A control circuit for an electronic ballast, the circuit comprising:

an on-time converter generating an on-time signal in response to a sensed phase-controlled power signal; and a microprocessor responsive to the on-time signal and generating a dimming control signal, wherein the on-time converter comprises:

a rectifier operably connected to receive the sensed phase-controlled power signal;

a clipping circuit operably connected to the rectifier; and a switching circuit operably connected to the clipping circuit through an isolator, the switching circuit being operably connected to transmit the on-time signal.

2. The circuit of claim 1, wherein the isolator is selected from the group consisting of: optocouplers and isolation transformers.

3. The circuit of claim 1, wherein the clipping circuit comprises:

a voltage divider having a first resistor and a second resistor connected in series;

a first isolation path of the isolator, the first isolation path connected in series with the second resistor; and a Zener diode;

wherein the Zener diode is connected in parallel with the second resistor and the first isolation path.

4. The circuit of claim 1, wherein the rectifier is a half wave rectifier.

5. The circuit of claim 1, wherein the dimming control signal is a linear function of the on-time signal.

6. A control circuit for an electronic ballast, the circuit comprising:

an on-time converter generating an on-time signal in response to a sensed phase-controlled power signal;

a microprocessor responsive to the on-time signal and generating a dimming control signal; and a filter operably connected to receive a pulsed dimming control signal from the microprocessor and to generate the dimming control signal.

7. The circuit of claim 6, wherein the dimming control signal is a linear function of the on-time signal.

8. A control circuit for an electronic ballast, the circuit comprising:

an on-time converter generating an on-time signal in response to a sensed phase-controlled power signal; and a microprocessor responsive to the on-time signal and generating a dimming control signal; wherein the on-time converter comprises:

a scaling circuit operably connected to receive the sensed phase-controlled power signal; and a comparator operably connected to the scaling circuit, the comparator transmitting the on-time signal.

9. The circuit of claim 8, wherein the dimming control signal is a linear function of the on-time signal.

10. A lamp control method for an electronic ballast, the method comprising:

sensing phase-controlled power;

determining on-time for the sensed phase-controlled power; and controlling lamp dimming in response to the on-time, wherein the determining step comprises:

rectifying the sensed phase-controlled power to generate rectified phase-controlled power;

clipping the rectified phase-controlled power to generate an on-time pulse;

measuring duration of the on-time pulse to determine the on-time.

11. The method of claim 10, wherein the measuring step comprises measuring time when the on-time pulse is beyond a predetermined level.

12. The method of claim 10, wherein the measuring step comprises measuring time between the leading edge and the lagging edge of the on-time pulse.

13. A lamp control method for an electronic ballast, the method comprising:

sensing phase-controlled power;

determining on-time for the sensed phase-controlled power; and controlling lamp dimming in response to the on-time, wherein the determining step comprises:

rectifying the phase-controlled power to generate rectified phase-controlled power;

clipping the rectified phase-controlled power to generate a series of on-time pulses;

measuring duration for each of the series of on-times pulses; and averaging the durations to determine the on-time.

14. The method of claim 13, wherein the averaging is selected from the group consisting of moving averaging and time-weighted averaging.

15. A lamp control method for an electronic ballast, the method comprising:

sensing phase-controlled power;

determining on-time for the sensed phase-controlled power; and controlling lamp dimming in response to the on-time, wherein the determining comprises:

scaling the phase-controlled power to generate scaled phase-controlled power; and comparing the scaled phase-controlled power to a predetermined level to determine the on-time.

16. A lamp control system comprising:

means for sensing phase-controlled power;

means for determining on-time for the sensed phase-controlled power; and means for controlling lamp dimming in response to the on-time, wherein the means for determining comprises:

means for rectifying the sensed phase-controlled power to generate rectified phase-controlled power;

means for clipping the rectified phase-controlled power to generate an on-time pulse;

means for measuring duration of the on-time pulse to determine the on-time.

17. The system of claim 16, wherein the means for measuring comprises means for measuring time when the on-time pulse is beyond a predetermined level.

18. A lamp control system comprising:

means for sensing phase-controlled power;

means for determining on-time for the sensed phase-controlled power; and means for controlling lamp dimming in response to the on-time, wherein the means for determining comprises:

means for rectifying the sensed phase-controlled power to generate rectified phase-controlled power;

means for clipping the rectified phase-controlled power to generate a series of on-time pulses;

means for measuring duration for each of the series of on-times pulses; and means for averaging the durations to determine the on-time.

19. The system of claim 18, wherein the means for averaging comprises means for moving averaging.

20. A lamp control system comprising:

means for sensing phase-controlled power;

means for determining on-time for the sensed phase-controlled power; and means for controlling lamp dimming in response to the on-time, wherein the means for determining comprises:

means for scaling the phase-controlled power to generate scaled phase-controlled power; and means for comparing the scaled phase-controlled power to a predetermined level to determine the on-time.

21. A control circuit for an electronic ballast having a boost/power factor controller, the circuit comprising:

a line voltage detector generating a line voltage signal in response to a sensed phase-controlled power signal;

a microprocessor being responsive to the line voltage signal and generating a capacitance selector signal;

a capacitance circuit being responsive to the capacitance selector signal to adjust capacitance of the boost/power factor controller; and an on-time converter, the on-time converter generating an on-time signal in response to the sensed phase-controlled power signal; wherein the microprocessor is responsive to the on-time signal to generate a dimming control signal, and wherein the on-time converter comprises:

a rectifier operably connected to receive the sensed phase-controlled power signal;

a clipping circuit operably connected to the rectifier; and a switching circuit operably connected to the clipping circuit through an isolator, the switching circuit being operably connected to transmit the on-time signal.

22. A lamp control method for an electronic ballast, the method comprising:

sensing a phase-controlled power;

determining line voltage for the sensed phase-controlled power;

adjusting boost/power factor controller capacitance in response to the line voltage;

determining on-time for the sensed phase-controlled power; and controlling lamp dimming in response to the on-time, wherein the determining step comprises:

rectifying the sensed phase-controlled power to generate rectified phase-controlled power;

clipping the rectified phase-controlled power to generate an on-time pulse;

measuring duration of the on-time pulse to determine the on-time.

* * * * *